US008182081B2

(12) United States Patent
Yamamoto et al.

(10) Patent No.: US 8,182,081 B2
(45) Date of Patent: May 22, 2012

(54) INKJET RECORDING APPARATUS

(75) Inventors: Hideki Yamamoto, Nagoya (JP); Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 474 days.

(21) Appl. No.: 12/412,393

(22) Filed: Mar. 27, 2009

(65) Prior Publication Data

US 2009/0244247 A1 Oct. 1, 2009

(30) Foreign Application Priority Data

Mar. 27, 2008 (JP) ..... 2008-083450

(51) Int. Cl.
*B41J 2/01* (2006.01)

(52) U.S. Cl. ..... 347/104; 347/101; 347/34

(58) Field of Classification Search ..... 347/104, 347/101, 102, 103, 34, 25
See application file for complete search history.

(56) References Cited

U.S. PATENT DOCUMENTS

| | | | | |
|---|---|---|---|---|
| 6,981,766 | B2 * | 1/2006 | Tsuji | 347/104 |
| 7,441,857 | B2 * | 10/2008 | Murase | 347/104 |
| 2002/0041303 | A1 * | 4/2002 | Yoshinaga | 347/22 |
| 2002/0047885 | A1 * | 4/2002 | Miyawaki et al. | 347/104 |
| 2004/0169711 | A1 * | 9/2004 | Tsuji et al. | 347/104 |
| 2005/0110857 | A1 * | 5/2005 | Matsumoto et al. | 347/104 |
| 2005/0122372 | A1 * | 6/2005 | Shimizu | 347/22 |
| 2009/0244242 | A1 * | 10/2009 | Sawada | 347/104 |

FOREIGN PATENT DOCUMENTS

| | | | |
|---|---|---|---|
| JP | 62-251147 | A | 10/1987 |
| JP | 7-025007 | A | 1/1995 |
| JP | 2000-272104 | A | 10/2000 |
| JP | 2004-276381 | A | 10/2004 |
| JP | 2005-271314 | A | 10/2005 |
| JP | 2006-069739 | A | 3/2006 |
| JP | 2006-272771 | A | 10/2006 |
| JP | 2006-315226 | A | 11/2006 |
| JP | 2006315226 | A * | 11/2006 |
| JP | 2007-216420 | A | 8/2007 |

OTHER PUBLICATIONS

JP Office Action dtd Jun. 15, 2010, JP Appln. 2008-083450, English translation.

* cited by examiner

*Primary Examiner* — Manish S Shah
(74) *Attorney, Agent, or Firm* — Banner & Witcoff, Ltd.

(57) ABSTRACT

An inkjet recording apparatus may include at least one inkjet head configured to eject ink onto a recording medium. The inkjet recording apparatus may also include a conveying device configured to convey the recording medium in a conveying direction, the conveying device including a recording-medium support surface that opposes the inkjet head and includes a plurality of holes. The inkjet recording apparatus may further include a suction device configured to suck air through the holes to attach the recording medium to the recording-medium support surface. The inkjet recording apparatus may yet further include a duct including an opposing opening that opposes the suction device via the recording-medium support surface, and a non-opposing opening that does not oppose the suction device.

11 Claims, 5 Drawing Sheets

INKJET RECORDING APPARATUS

CROSS REFERENCE TO RELATED APPLICATION

This application claims priority to Japanese Patent Application No. 2008-83450, filed Mar. 27, 2008, the entire subject matter and disclosure of which is incorporated herein by reference.

BACKGROUND OF THE DISCLOSURE

1. Field of the Disclosure

The features herein relate to an inkjet recording apparatus that records an image by ejecting ink onto a recording medium (e.g., an inkjet printer).

2. Description of the Related Art

A known inkjet recording apparatus includes a conveying device for conveying a recording medium by electrostatically sucking the recording medium, a recording head for ejecting ink onto the recording medium conveyed by the conveying device, and a mist collection device that sucks ink mist rising from the recording head. The mist collection device of the inkjet recording apparatus includes a duct having a suction portion arranged adjacent to the wall surface on the downstream side of the recording head, a fan disposed in the duct, and a filter for collecting ink mist. Driving of the fan causes the suction portion to suck ink mist.

The known inkjet recording apparatus includes a fan dedicated for suction of ink mist. When the recording medium is attached to a conveying belt by air suction instead of electrostatic suction, a fan for attaching the recording medium to the conveying belt and a fan for sucking ink mist are required.

SUMMARY OF THE DISCLOSURE

An inkjet recording apparatus for sucking ink mist using a reduced number of components would be beneficial.

According to one illustrative embodiment herein, an inkjet recording apparatus may include at least one inkjet head configured to eject ink onto a recording medium. The inkjet recording apparatus may also include a conveying device configured to convey the recording medium in a conveying direction, the conveying device including a recording-medium support surface that opposes the inkjet head and includes a plurality of holes. The inkjet recording apparatus may further include a suction device configured to suck air through the holes to attach the recording medium to the recording-medium support surface. The inkjet recording apparatus may yet further include a duct including a first opening opposing the holes through which the suction device sucks air, and a second opening disposed on a downstream side of the inkjet head positioned on the most downstream side in the conveying direction.

According to another illustrative embodiment herein, an inkjet recording apparatus may include at least one inkjet head configured to eject ink onto a recording medium. The inkjet recording apparatus may also include a conveying device configured to convey the recording medium in a conveying direction, the conveying device including a recording-medium support surface that opposes the inkjet head and includes a plurality of holes. The inkjet recording apparatus may further include a suction device configured to suck air through the holes to attach the recording medium to the recording-medium support surface. The inkjet recording apparatus may yet further include a duct including an opposing opening that opposes the suction device via the recording-medium support surface, and a non-opposing opening that does not oppose the suction device.

Other, features, and advantages will be apparent to those skilled in the art from the following detailed description and accompanying drawings.

BRIEF DESCRIPTION OF THE DRAWINGS

Illustrative embodiments of an inkjet recording apparatus are described with reference to the accompanying drawings, which are given by way of example only, and are not intended to limit the present disclosure.

DESCRIPTION OF ILLUSTRATIVE EMBODIMENTS

Various illustrative embodiments, and their features and advantages, may be understood by referring to FIGS. 1-5, like numerals being used for corresponding parts in the various drawings.

Figure 1:
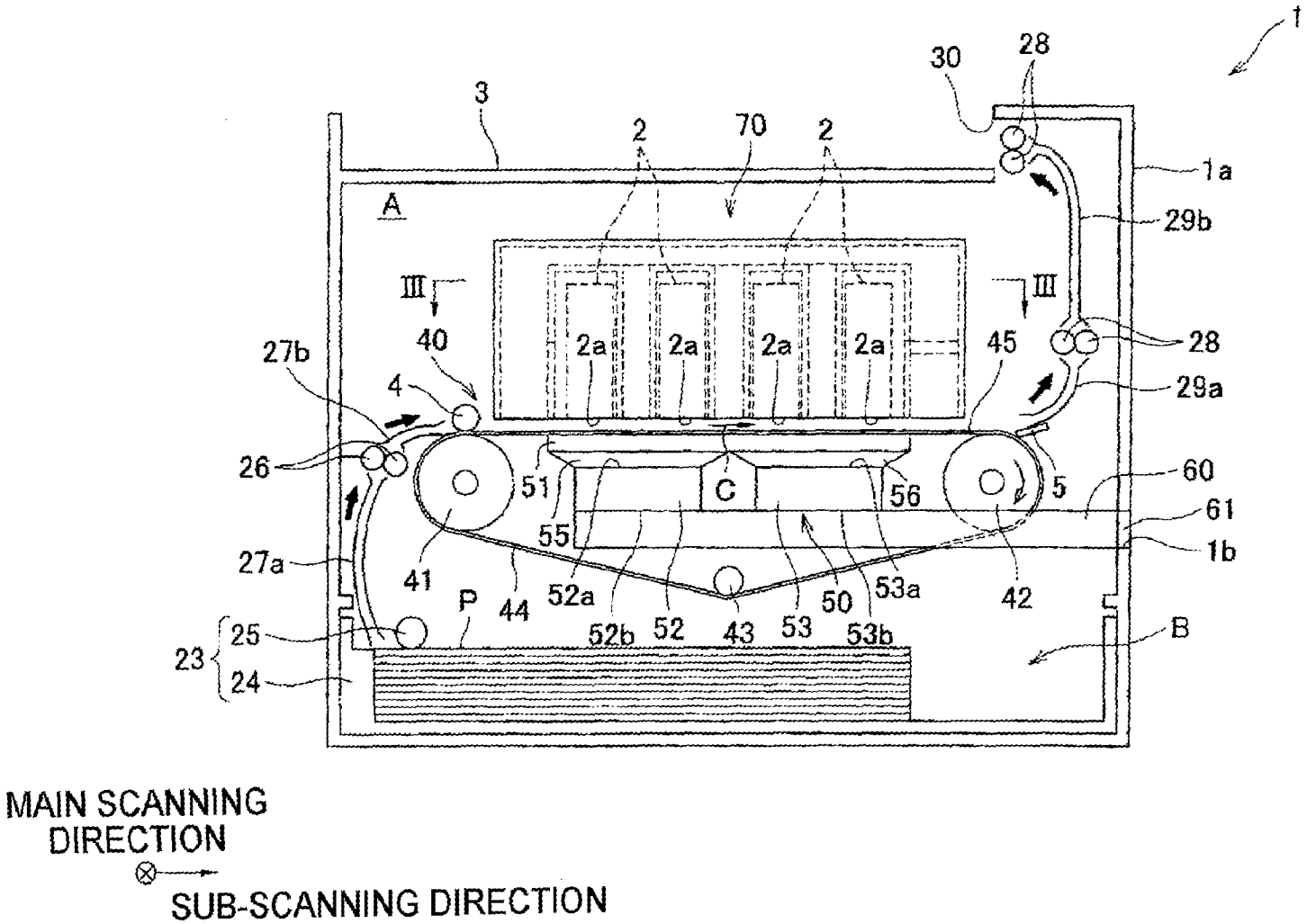
FIG. 1 is a schematic side view showing an internal structure of an inkjet printer according to an illustrative embodiment.

Referring to FIG. 1, an inkjet printer 1 may include a rectangular-parallelepiped-shaped case 1*a*. A sheet discharge portion 3 may be positioned at the top of the case 1*a*. The inside of the case 1*a* may be partitioned into a plurality of, e.g., two, areas, namely, from above, an area A and an area B. The area A may accommodate a plurality of, e.g., four, inkjet heads 2 for ejecting magenta ink, cyan ink, yellow ink, and black ink, and a conveying device 40 for conveying a sheet P in a conveying direction C. The area B may accommodate a sheet feeding device 23. In this illustrative embodiment, a direction parallel to the conveying direction C, in which the sheet P is configured to be conveyed by the conveying device 40, may be referred to as a sub-scanning direction, and a direction perpendicular to the sub-scanning direction and along the horizontal plane may be referred to as a main scanning direction.

A sheet conveying path may be positioned inside the inkjet printer 1. The sheet conveying path may extend from the sheet feeding device 23 to the sheet discharge portion 3, along which the sheet P is conveyed, indicated by thick arrows shown in FIG. 1. The sheet feeding device 23 may include a sheet feed cassette 24 capable of accommodating a stack of the sheets P and a sheet feed roller 25 for feeding the sheets P from the sheet feed cassette 24. The sheet feed roller 25 may feed a sheet P on the top of the stack of sheets P accommodated in the sheet feed cassette 24. The sheet P fed from the sheet feed roller 25 may be guided by guides 27*a* and 27*b* by being nipped between a pair of rollers 26 to the conveying device 40.

The conveying device 40 may include a plurality of, e.g., three, rollers 41 to 43 having rotational axes parallel to one another and an endless conveying belt 44 that runs around the rollers 41 to 43. The roller 43 may be a tension roller which is in contact with the inner circumference of the conveying belt 44 at the lower loop to apply tension to the conveying belt 44. The rollers 41 and 42 may be belt rollers.

Figure 2:
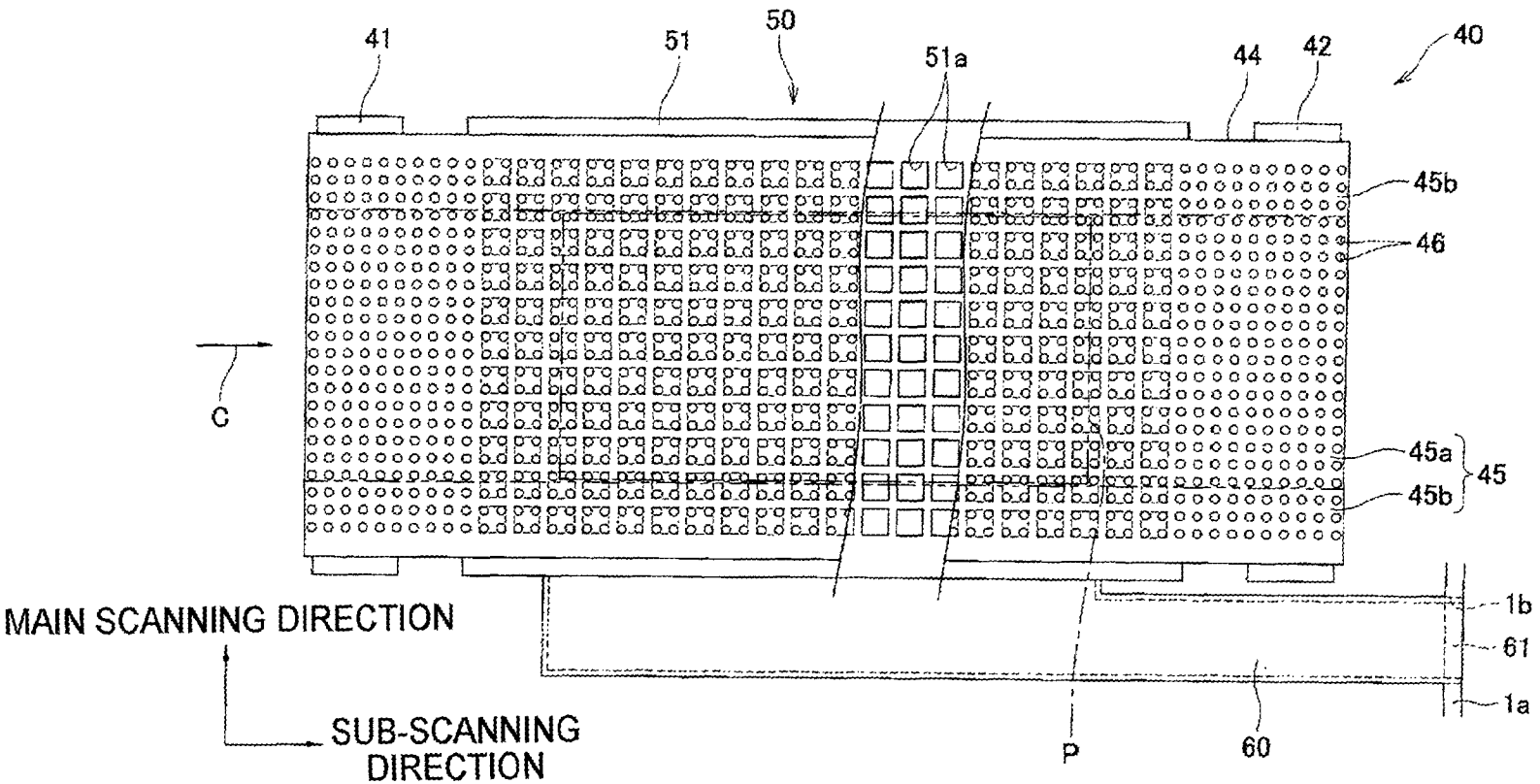
FIG. 2 is a plan view showing a conveying device and the vicinity thereof.

Referring to FIG. 2, the conveying belt 44 may include a plurality of holes 46 penetrating therethrough in the thickness direction in an outer circumference (e.g., recording-medium support surface) 45 for supporting the sheet P. The outer circumference 45 may be separated into a belt-shaped supporting area 45*a* for supporting a sheet P fed from the sheet feeding device 23 and belt-shaped non-supporting areas 45*b* positioned on both sides of the supporting area 45*a* in the main scanning direction. In FIG. 2, among the three areas separated by two alternate long and two short dashes lines parallel to the sub-scanning direction, the area in the middle may correspond to the supporting area 45*a*, and the areas on both sides of the supporting area 45*a* may correspond to the non-supporting areas 45*b*.

The supporting area 45*a* may have a length greater than the sheet P in the sub-scanning direction and a length substantially equal to the sheet P in the main scanning direction. Thus, the sheet P may be reliably supported by the supporting area 45*a*. The belt rollers 41 and 42 may be positioned on the upstream and downstream sides of the inkjet heads 2 in the conveying direction C, respectively. The outer circumference 45 of the conveying belt 44 may extend toward the upstream and downstream sides from the region opposing the plurality of, e.g., four, inkjet heads 2.

The holes 46 may be formed in both the supporting area 45*a* and the non-supporting areas 45*b*. The holes 46 may be arranged over the entirety of the outer circumference 45 of the conveying belt 44. The non-supporting areas 45*b*, which normally do not support the sheet P, may suck and support a sheet P that is displaced on the non-supporting areas 45*b* by disposing the holes 46 in the non-supporting areas 45*b*.

Referring back to FIG. 1, a suction device 50 may be disposed at a position opposing the inkjet heads 2 in the position enclosed by the conveying belt 44. The suction device 50 may include a substantially rectangular-parallelepiped-shaped platen 51, a plurality of, e.g., two, rotary fans 52 and 53 positioned below the platen 51, a duct 55 connected to the rotary fan 52, and a duct 56 connected to the rotary fan 53.

Referring to FIG. 2, the platen 51 may include a plurality of openings 51*a* penetrating therethrough in the thickness direction and arranged over the entirety thereof in the top surface. Each opening 51*a* may have a size equivalent to a plurality of, e.g., four, holes 46 opposing thereto. The platen 51 may be slightly greater in length in the main scanning direction than the conveying belt 44. The platen 51 may be slightly greater in length in the sub-scanning direction than the region opposing the plurality of, e.g., four, inkjet heads 2. The top surface of the platen 51 may be in contact with the inner circumference of the upper loop of the conveying belt 44 and may support the conveying belt 44 from the inner circumferential side. Thus, the outer circumference 45 of the upper loop of the conveying belt 44 and the lower surfaces of the inkjet heads 2, that is, ejecting surfaces 2*a*, may be parallel to each other in an opposing manner. A small gap may be formed between the ejecting surfaces 2*a* and the outer circumference 45 of the conveying belt 44. The gap may constitute the sheet conveying path.

The rotary fans 52 and 53 may be substantially rectangular-parallelepiped-shaped. The rotary fans 52 and 53 may suck air from suction ports 52*a* and 53*a* in the top surfaces. The rotary fans 52 and 53 may also discharge the sucked air from discharge ports 52*b* and 53*b* in the lower surfaces by rotating rotary vanes disposed inside thereof. The rotary fans 52 and 53 may be positioned side by side in the conveying direction C.

The duct 55 may connect the platen 51 and the rotary fan 52. The duct 55 may provide communication by air between the suction port 52*a* and the openings 51*a* positioned in the upstream half of the platen 51 in the conveying direction C. The duct 56 may connect the platen 51 and the rotary fans 53. The duct 56 may provide communication by air between the suction port 53*a* and the openings 51*a* positioned in the downstream half of the platen 51 in the conveying direction C.

The discharge ports 52*b* and 53*b* of the rotary fans 52 and 53 may be connected to a tubular duct 60. The duct 60 may extend from the region opposing the discharge ports 52*b* and the 53*b* in the sub-scanning direction (in the lower side in FIG. 2) to outside of the conveying device 40, and may extend therefrom in the conveying direction C. The duct 60 may be disposed to the lower surfaces of the rotary fans 52 and 53 at one end and to an opening 1*b* formed in the case 1*a* at the other end. The duct 60 may discharge the air from the rotary fans 52 and 53 to outside of the case 1*a*. The duct 60 may be disposed with a filter 61 at the other end, which collects ink mist sucked by the suction device 50. Thus, the ink mist may be not discharged from the case 1*a*.

Referring back to FIG. 1, a press roller 4 for pressing the sheet P fed from the sheet feeding device 23 onto the outer circumference 45 may be disposed at a position on the upstream side of the inkjet head 2 positioned on the most upstream side in the conveying direction C so as to oppose the belt roller 41. The press roller 4 may be urged against the outer circumference 45 by an elastic component such as a spring. The press roller 4 may be a driven roller that rotates along with the rotation of the conveying belt 44.

When the belt roller 42 rotates clockwise in FIG. 1, the conveying belt 44 may rotate. The rotation of the conveying belt 44 may rotate the driven rollers, namely, the tension roller 43, the press roller 4, and the belt roller 41. When the rotary fans 52 and 53 are driven to suck air from all the openings 51*a* through the ducts 55 and 56, a sheet P fed from the sheet feeding device 23 may be conveyed in the conveying direction C while being attached to the outer circumference 45 when it passes the region opposing the platen 51.

The plurality of, e.g., four, inkjet heads 2 may extend in the main scanning direction and may be arranged in parallel in the sub-scanning direction. The ejecting surfaces 2*a* of the inkjet heads 2 may have ejection portions extending in the main scanning direction. The ejection portions each may include a plurality of ink ejecting ports (not shown). When a sheet P, conveyed while being held on the outer circumference 45 of the conveying belt 44, passes immediately beneath the plurality of, e.g., four, inkjet heads 2, the inkjet heads 2 may eject ink of each color onto the top surface of the sheet P. Thus, a desired color image may be formed on the sheet P.

Figure 3:
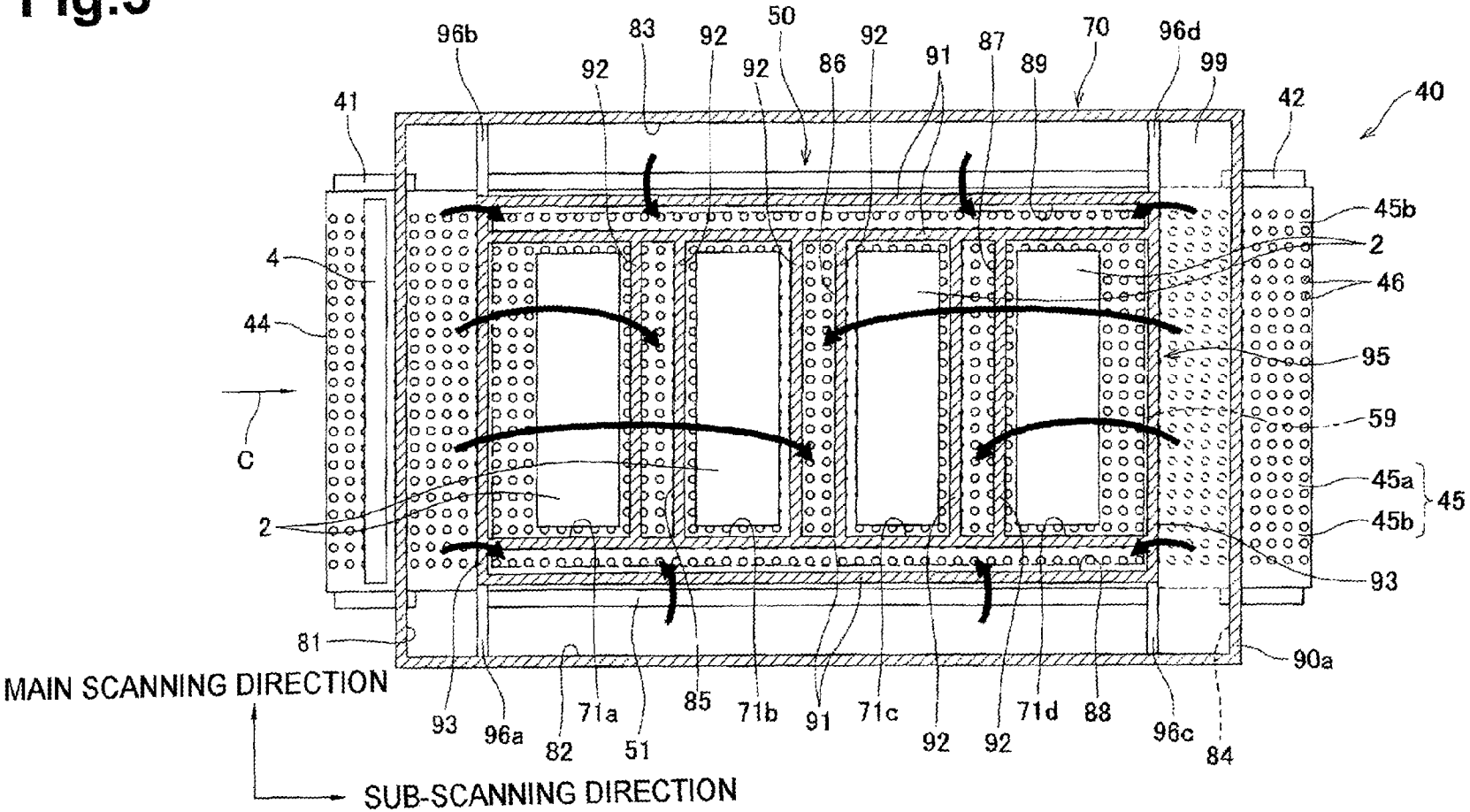
FIG. 3 is a sectional plan view taken along line III-III in FIG. 1.
Figure 4:
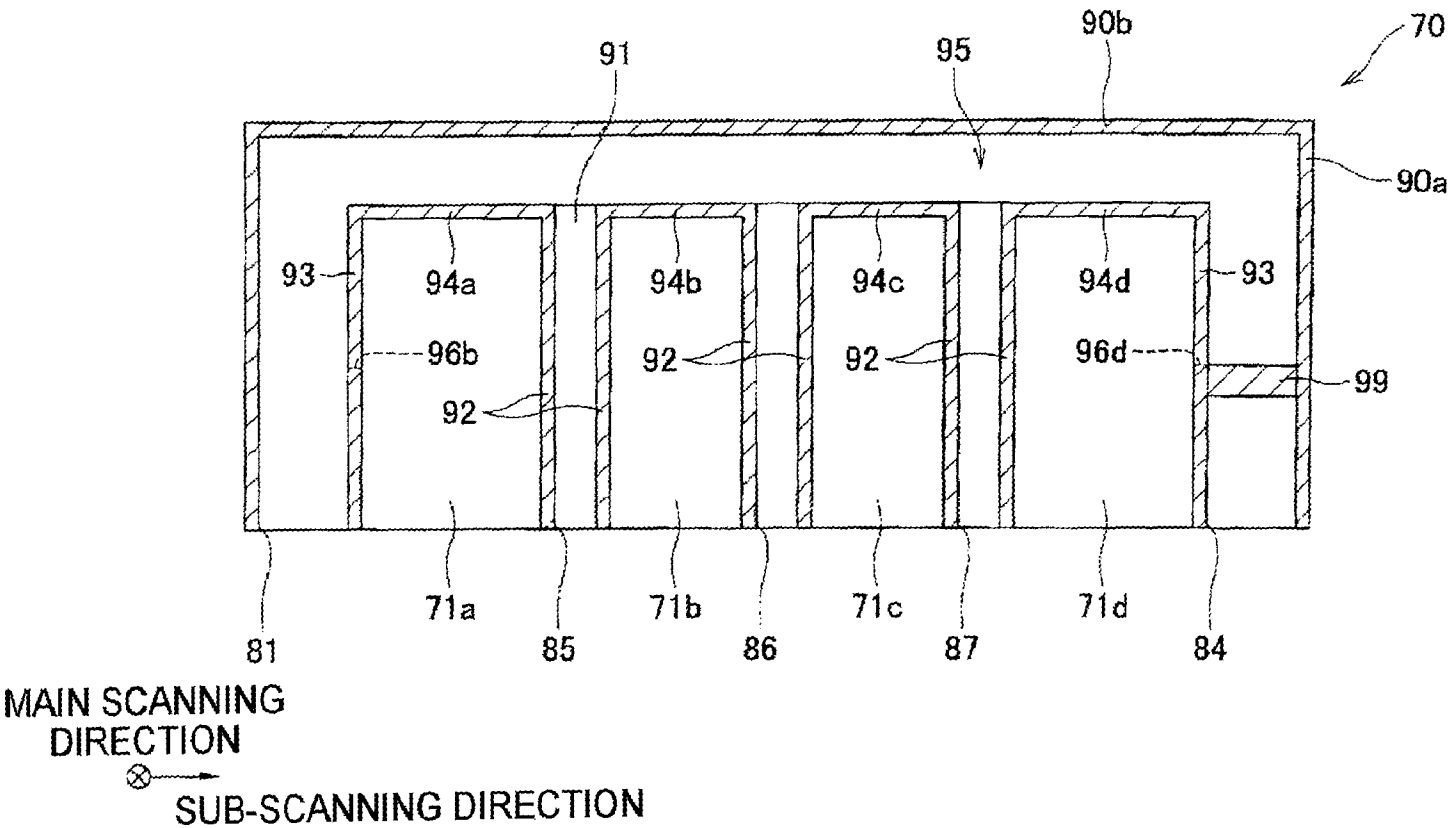
FIG. 4 is a sectional side view of a duct.

Referring to FIGS. 3 and 4, the printer 1 may include a duct 70 for covering the plurality of, e.g., four, inkjet heads 2. The duct 70 may be substantially rectangular-parallelepiped-shaped. The duct 70 may include an enclosing outer wall 90*a* that is perpendicular to the outer circumference 45 of the conveying belt 44. The enclosing outer wall 90*a* may have a rectangular-parallelepiped-shape, and the lower portion thereof may be opened. The duct 70 may also include an upper wall 90*b* that is parallel to the outer circumference 45 of the conveying belt 44. The upper wall 90*b* may cover the top portion of the outer wall 90*a*. The duct 70 may further include a plurality of, e.g., four, dividing walls 91 with each being perpendicular to the outer circumference 45 of the conveying belt 44. The dividing walls 91 may extend in the sub-scanning direction. The duct 70 may yet further include a plurality of, e.g., six, dividing walls 92 with each perpendicular to the outer circumference 45 of the conveying belt 44. The dividing walls 92 may extend in the main scanning direction. The duct 70 may yet further include a plurality of, e.g., two, dividing walls 93 with each perpendicular to the outer circumference 45 of the conveying belt 44. The dividing walls 93 may extend in the main scanning direction and may be disposed on both ends of the plurality of dividing walls 91. Accommodating chambers 71*a* to 71*d* for accommodating the inkjet heads 2 and a plurality of, e.g., nine, openings 81 to 89 communicating by air with each other in the upper portion inside the duct 70 may be defined in the in the duct 70. The lower end of the duct 70 and the ejecting surfaces 2*a* may be substantially level with each other, and the ejecting surfaces 2*a* may be exposed to the supporting area 45*a*. The plurality of, e.g., four, inkjet heads 2 may be fixed to the wall surfaces of the accommodating chambers 71*a* to 71*d* with connecting members (not shown).

Referring to FIG. 4, the dividing walls 91 to 93 may be lower than the outer wall 90*a* such that the upper ends of the dividing walls 91 to 93 and the upper wall 90*b* are separated. Upper walls 94*a* to 94*d* functioning as the ceilings of the accommodating chambers 71*a* to 71*d* may be disposed in the area surrounded by the plurality of, e.g., two, inner dividing walls 91 and the plurality of, e.g., two, dividing walls 93 and at the areas not opposing the openings 85 to 87. That is, the accommodating chambers 71*a* to 71*d* may not communicate with the plurality of, e.g., nine, openings 81 to 89.

The plurality of, e.g., six, dividing walls 92 may be connected to the plurality of, e.g., two, inner dividing walls 91. The plurality of, e.g., four, dividing walls 91 may be connected to the plurality of, e.g., two, dividing walls 93. An assembly 95, including the dividing walls 91 to 93 and the upper walls 94*a* to 94*d* connected one another, may be connected to the outer wall 90*a* through a plurality of, e.g., four, connecting members 96*a* to 96*d*. The connecting members 96*a* to 96*d* may be disposed such that their upper ends are positioned at the midpoint of the dividing walls 93 in the height direction. That is, the connecting members 96*a* to 96*d* may be about half the height of the dividing walls 93.

Referring back to FIG. 3, the openings (e.g., first opening) 85 to 89 may be positioned in the area surrounded by the plurality of, e.g., two, outer dividing walls 91 and the dividing walls 93. More specifically, the openings 85 to 87 may extend in the main scanning direction and may be disposed at positions between the accommodating chambers 71*a* to 71*d*, where large part of the openings 85 to 87 opposes the supporting area 45*a*. The openings 88 and 89 may extend in the sub-scanning direction and may be disposed at positions on both sides of the accommodating chambers 71*a* to 71*d* and the openings 85 to 87 in the main scanning direction, the positions opposing the non-supporting areas 45*b*. Thus, the openings 85 to 87 may oppose the holes 46 formed in the supporting area 45*a*. The openings 88 and 89 may oppose the holes 46 formed in the non-supporting areas 45*b*. The area surrounded by the plurality of, e.g., two, outer dividing walls 91 and the dividing walls 93 may oppose all the openings 51*a* formed in the platen 51. The openings 85 to 89 may oppose a suction area 59 indicated by the alternate long and two short dashes line in FIG. 3, in which air is sucked. Thus, when the suction device 50 is driven, the air in the duct 70 may flow through the openings 85 to 89 toward the suction device 50.

The openings 81 to 84 may be positioned at an enclosed area formed between the outer wall 90*a* and the assembly 95 (e.g., an area opposing the area surrounding the suction area 59). More specifically, the opening (e.g., fourth opening) 81 may extend in the main scanning direction. The opening 81 may be disposed at a position on the upstream side of the inkjet head 2, which is positioned on the most upstream side, in the conveying direction C and adjacent to the inkjet head 2, the position not opposing the platen 51 but opposing the outer circumference 45 of the conveying belt 44. The opening (e.g., second opening) 84 may extend in the main scanning direction. The opening 84 may be disposed at a position, that is positioned on the downstream side of the inkjet head 2, which is positioned on the most downstream side, in the conveying direction C and adjacent to the inkjet head 2, the position not opposing the platen 51 but opposing the outer circumference 45 of the conveying belt 44. The openings 81 and 84 may be longer than the sheet P in the main scanning direction. The phrase "the openings 81 and 84 are each adjacent to the corresponding inkjet head 2" also refers to a state in which there is a relatively small amount of space between each of the openings 81 and 84 and the corresponding inkjet head 2. The openings (e.g., third openings) 82 and 83 may extend in the sub-scanning direction and may be disposed at positions on the outside of the inkjet heads 2 in the main scanning direction, where a large part of the openings 82 and 83 does not oppose the outer circumference 45 or the platen 51. Although the openings 81 to 84 are disposed at areas not opposing the suction area 59, the openings 81 to 84 may partially oppose the suction area 59 as long as the suction force exerted by the suction device 50 does not act on the entire openings.

Furthermore, in the duct 70, a filter 99 may be disposed between a downstream portion of the outer wall 90*a* in the conveying direction C, and the dividing wall 93 on the downstream side in the conveying direction C and the connecting members 96*c* and 96*d*. Thus, ink mist entering the duct 70 through the opening 84 may be collected by the filter 99.

As has been described, the openings 81 to 84 may not oppose the suction area 59. When the suction device 50 is driven, the air outside the duct 70 may flow through the openings 81 to 84 into the duct 70 as shown by the thick arrows in FIG. 3. Then, the air flowing into the duct 70 may go through the openings 85 to 89 toward the suction device 50.

Referring back to FIG. 1, a separation plate 5 may be disposed in the sheet conveying path, at a position opposing the belt roller 42 with the conveying belt 44 therebetween. The separation plate 5 may separate the sheet P held on the outer circumference 45 of the conveying belt 44 from the outer circumference 45. The sheet P separated from the outer circumference 45 by the separation plate 5 may be guided by the guides 29*a* and 29*b*, may be conveyed by being nipped between a plurality of, e.g., two, pairs of feed rollers 28, and may be discharged onto the sheet discharge portion 3 formed on the top portion of the case 1*a* through the opening 30. Thus, the sheet P, on which an image is formed, may be discharged onto the sheet discharge portion 3.

Airflow in the duct 70 during image formation on the sheet P will be described below. When an image is to be formed on the sheet P, the sheet feeding device 23 may be driven to feed the sheet P to the conveying device 40. Then, the conveying device 40 may be driven to convey the sheet P in the conveying direction C. At this time, the rotary fans 52 and 53 of the suction device 50 may be driven to attach the sheet P fed from the sheet feeding device 23 to the outer circumference 45.

Figure 5A:
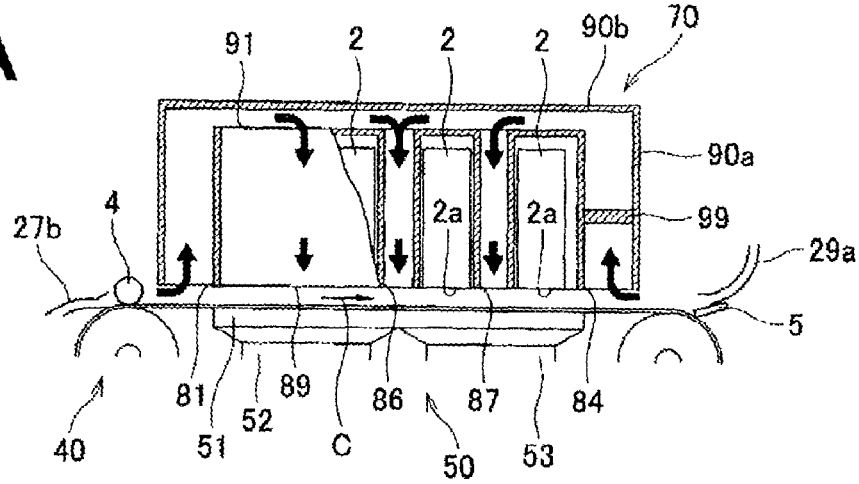
FIGS. 5A to 5C show airflow in the duct during conveyance of a sheet by the conveying device.
Figure 5B:
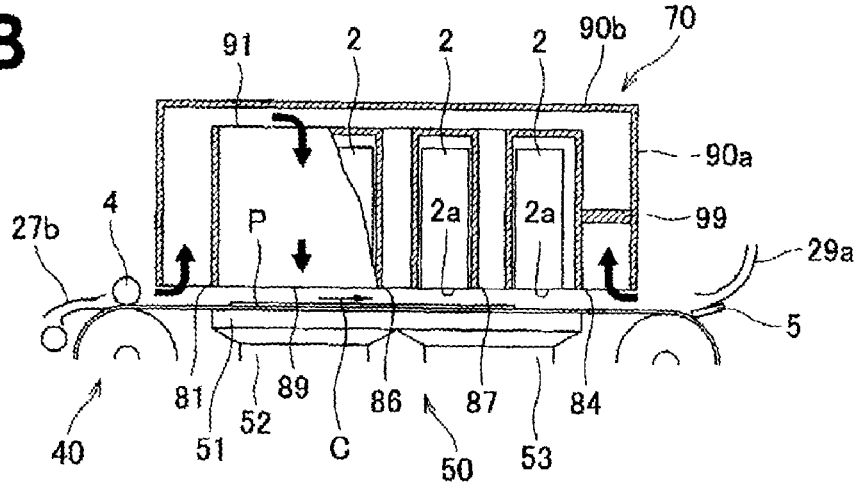

Referring to FIGS. 3 and 5A, when the rotary fans 52 and 53 are driven, the suction force of the suction device 50 may act on the plurality of, e.g., five, openings 85 to 89 opposing the suction area 59. Therefore, the airflow directed from the plurality of, e.g., four, openings 81 to 84 to the openings 85 to 89 may be generated in the duct 70. As a result, air may flow from the openings 81 to 84 into the duct 70, and the air in the duct 70 may be discharged through the openings 85 to 89 toward the suction device 50. The discharged air may be sucked by the rotary fans 52 and 53 through the holes 46 and 51*a*, and may be discharged from the case 1*a* through the duct 60. In this state, referring to FIG. 5B, a sheet P conveyed to the outer circumference 45 may be conveyed in the conveying direction C while being attached to and supported by the supporting area 45*a* of the outer circumference 45.

Then, when the sheet P passes the region opposing the inkjet heads 2, the inkjet heads 2 may eject ink to form an image on a desired position of the sheet P. At this time, when the sheet P opposes the plurality of, e.g., three, openings 85 to 87 between the inkjet heads 2, the air in the duct 70 may not flow toward the suction device 50 through the openings 85 to 87. Because the suction force by the suction device 50 hardly acts on the openings 85 to 87 opposing the sheet P. However, the suction force by the suction device 50 may act on the plurality of, e.g., two openings 88 and 89, because the openings 88 and 89 are disposed at positions opposing the holes 46 in the non-supporting areas 45*b*. Therefore, air may flow into the duct 70 through the openings 81 to 84 and may be discharged through the openings 88 and 89. Accordingly, it is possible to suck ink mist from the openings 81 to 84 even when the sheet P opposes the openings 85 to 87.

Figure 5C:
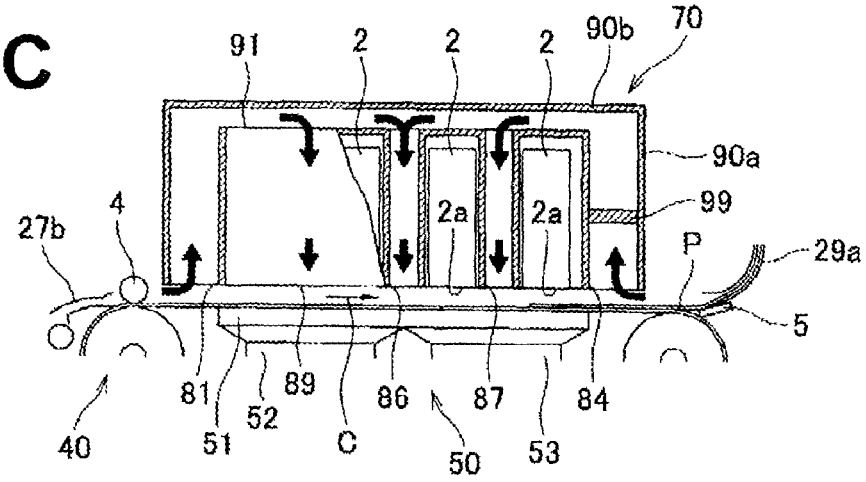

Referring to FIG. 5C, when the inkjet heads 2 eject ink, ink mist may rise around the ejecting surfaces 2*a*. Most of the ink mist may be carried to the downstream side in the conveying direction C by the airflow in the conveying direction C generated by the conveyance of the sheet P. When the ink mist carried to the downstream side in the conveying direction C passes the region opposing the opening 84, the ink mist and air may be sucked into the duct 70 through the opening 84. The ink mist sucked into the duct 70 may be collected by the filter 99, and only air may pass through the filter 99 in the airflow direction in the duct 70. Therefore, the ink mist sucked into the duct 70 may be prevented from being deposited on the sheet P and may be less likely to be discharged to the suction device 50 through the openings 85 to 89. Thus, the ink mist may be less likely to be deposited on the outer circumference 45. Even if the duct 70 is not provided with the filter 99, the ink mist may be less likely to be deposited on the sheet P because most of the ink mist sucked into the duct 70 is discharged to the suction device 50 through the openings 85 to 87 after the sheet P, conveyed at a relatively high speed, passes the area opposing the openings 85 to 87. Furthermore, because the opening 84 is greater in length in the main scanning direction than the inkjet heads 2, the ink mist may be sucked in a relatively large area.

In addition, because the plurality of, e.g., two, openings 82 and 83 are disposed on the outside of the inkjet heads 2 in the main scanning direction, the ink mist rising in the air on the outside of the inkjet heads 2 in the main scanning direction may be sucked. Furthermore, because the opening 81 is disposed on the upstream side of the inkjet head 2 positioned on the most upstream side in the conveying direction C, it may be possible to suck paper powder generated when the sheet P is pressed onto the outer circumference 45 by the press roller 4 and the ink mist rising in the air on the upstream side of the inkjet head 2 positioned on the most upstream side. The ink mist and paper powder sucked into the duct 70 and the suction device 50 may be collected by the filter 61, and only air may be discharged outside the case 1*a*.

The sheet P on which an image is formed by the inkjet heads 2 may be conveyed from the region opposing the inkjet heads 2 in the conveying direction C by the conveying device 40. At this time, as mentioned above, because air flows from the opening 84 into the duct 70, the airflow directed from the outside of the duct 70 to the opening 84 may be generated. Most of the airflow directed to the opening 84 may pass the region between the belt roller 42 and the opening 84, and the sheet P may be conveyed by the conveying device 40 such that the sheet P passes the region where the airflow passes. Thus, the sheet P may be subjected to the airflow, which may accelerate drying of the image. This may not require a drying device for drying the image on the sheet P, which may reduce the total number of components.

As has been described, in the inkjet printer 1 according to this illustrative embodiment, when the suction device 50 sucks the air, airflow directed from the openings 81 to 84 to the openings 85 to 89 may be generated in the duct 70. Therefore, the opening 84 disposed on the downstream side of the inkjet heads 2 in the conveying direction C may suck the ink mist generated when the inkjet heads 2 eject ink. Thus, the suction device 50 for attaching the sheet P to the outer circumference 45 may also be used to suck the ink mist. This may not require a dedicated fan and the like to suck the ink mist, which may reduce the total number of components.

Because the openings 85 to 87 are provided between the inkjet heads 2, the suction force of the suction device 50 may act on the air in the duct 70. Thus, the ink mist may be more effectively sucked from the openings 81 to 84.

Although, in the above-described illustrative embodiment, the duct 70 may have the plurality of, e.g., nine, openings 81 to 89 communicating with one another, a duct may have an opening at a position opposing the holes 46 through which air is sucked by the suction device 50 among the holes 46 and an opening at a position on the downstream side of the inkjet head 2 positioned on the most downstream side in the conveying direction. The duct may not have to include the openings 81 to 83. The duct may not have to include the openings 85 to 87. The opening 84 may have a smaller length in the main scanning direction than the inkjet heads 2. In addition, the opening 84 may not have to be disposed at the position opposing the outer circumference 45, and may be disposed at a position opposing the guides 29*a* and 29*b*, for example. One or none of the filters 61 and 99 may be disposed. The entirety of the outer circumference 45 of the conveying belt 44 may be the supporting area for supporting the sheet P. The supporting area 45*a* may have a smaller length in the sub-scanning direction than the sheet P.

Although illustrative embodiments have been described in detail herein, the scope of this patent is not limited thereto. It will be appreciated by those of ordinary skill in the relevant art that various modifications may be made without departing from the scope of the invention. Accordingly, the embodiments disclosed herein are exemplary, and are not limiting. It is to be understood that the scope of the invention is to be determined by the claims which follow.

What is claimed is:

1. An inkjet recording apparatus comprising:

an inkjet head configured to eject ink onto a recording medium;

a conveying device configured to convey a recording medium in a conveying direction, the conveying device comprising a recording-medium support surface that opposes the inkjet head and comprises a supporting area configured to support the recording medium on a first side of the recording-medium support surface that opposes the ink jet head;

a non-supporting area that does not support a recording medium when a recording medium is being conveyed to the recording-medium support surface, the non-supporting area disposed on a periphery of the supporting area on the first side of the recording-medium support surface in a direction perpendicular to the conveying direction; and a plurality of holes is provided on at least part of the supporting area and at least part of the non-supporting area;

a suction device configured to suck air through the holes, wherein air sucked through the holes in the supporting area causes a recording medium being conveyed to be attached to the recording-medium support surface, the suction device opposing a second side of the recording-medium support surface opposite to the first side; and a duct comprising a first opening opposing the first side of the recording-medium support surface including the holes provided on the non-supporting area through which the suction device sucks air, and a second opening disposed on a downstream side of the inkjet head, in the conveying direction.

2. The inkjet recording apparatus according to claim 1, wherein the second opening is longer than the inkjet head in a direction perpendicular to the conveying direction and parallel to the recording-medium support surface.

3. The inkjet recording apparatus according to claim 1, wherein the duct further comprises a third opening disposed outside of the inkjet head in a direction perpendicular to the conveying direction.

4. The inkjet recording apparatus according to claim 1, wherein the duct further comprises a third opening disposed on an upstream side of the inkjet head, in the conveying direction.

5. The inkjet recording apparatus according to claim 1, wherein the inkjet head is one of a plurality of inkjet heads, and wherein at least a part of the first opening is arranged between the plurality of inkjet heads.

6. The inkjet recording apparatus according to claim 1, wherein the second opening is positioned immediately adjacent to the inkjet head.

7. The inkjet recording apparatus according to claim 1, wherein the inkjet head is one of a plurality of inkjet heads, wherein the recording-medium support surface extends further toward the downstream side than the inkjet head that is positioned on the most downstream side in the conveying direction, and wherein the second opening opposes the recording-medium support surface.

8. The inkjet recording apparatus according to claim 1, further comprising a filter configured to collect ink mist sucked by the suction device.

9. The inkjet recording apparatus according to claim 1, wherein an area of the recording-medium support surface comprising the plurality of holes is configured to be longer than the recording medium in the conveying direction that the inkjet recording apparatus is configured to accommodate.

10. The inkjet recording apparatus according to claim 1, wherein the duct has a rectangular-parallelepiped-shape and is configured to cover a plurality of inkjet heads.

11. The inkjet recording apparatus according to claim 10, wherein the duct further comprises:

an enclosing outer wall, an upper wall configured to cover the top portion of the outer wall, and a plurality of dividing walls configured to divide inside of the enclosing outer wall and the upper wall.

* * * * *